US005245129A

United States Patent [19]

Kozuki

[11] Patent Number: 5,245,129

[45] Date of Patent: Sep. 14, 1993

[54] ELECTRONIC MUSICAL INSTRUMENT WHICH CLEARS A FIRST MUSICAL TONE PRIOR TO GENERATING A SECOND MUSICAL TONE

[75] Inventor: Koichi Kozuki, Hamamatsu, Japan

[73] Assignee: Yamaha Corporation, Hamamatsu, Japan

[21] Appl. No.: 466,495

[22] Filed: Jan. 17, 1990

[30] Foreign Application Priority Data

Jan. 19, 1989 [JP] Japan ..... 1-10795

[51] Int. Cl.[5] ..... G10H 1/057; G10H 1/06; G10H 1/18

[52] U.S. Cl. ..... 84/658; 84/659; 84/663

[58] Field of Search ..... 84/622-626, 84/653, 658-661, 663, 621, 617, 618, 627, 662, 683, 684, 687, 691, 701, 702, 703, DIG. 8

[56] References Cited

U.S. PATENT DOCUMENTS 4,182,210 1/1980 Nishimoto ..... 84/621
4,481,851 11/1984 Swain et al. ..... 84/618
4,570,520 2/1986 Deutsch et al. ..... 84/621
4,703,680 11/1987 Wachi et al. ..... 84/1.26
4,909,120 3/1990 Horiki et al. ..... 84/663
4,911,052 3/1990 Saito et al. ..... 84/617
4,928,569 5/1990 Kudo et al. ..... 84/663

FOREIGN PATENT DOCUMENTS 63-7394 2/1988 Japan .

*Primary Examiner*—Stanley J. Witkowski
*Assistant Examiner*—H. Kim
*Attorney, Agent, or Firm*—Spensley, Horn, Jubas & Lubitz

[57] ABSTRACT

A device(timer) is provided for measurement of lapse time from a predetermined portion of a first tone assigned to a tone production channel. When a new(-second) tone generation request is given to the tone production channel the tone being generated is force-dumped. The time required for force-dump, namely the waiting time until the new musical tone is generated is decided based on the count value of the timer. Upon the lapse of this waiting time the new musical tone is generated at the above-mentioned channel. Thereby the waiting time is best controlled.

17 Claims, 9 Drawing Sheets

FIg.(C)

(A):Main routine (B):Key ON event subroutine (C):Key OFF event subroutine (D):Sustain pedal subroutine (E):Tone color selection subroutine (F):Timer interruption

ELECTRONIC MUSICAL INSTRUMENT WHICH CLEARS A FIRST MUSICAL TONE PRIOR TO GENERATING A SECOND MUSICAL TONE

BACKGROUND OF THE INVENTION

1. Field of the Invention

This invention relates to an electronic musical instrument and especially to modification of a processing system which is applied when a musical tone to be generated is specified continuously or duplicately.

2. Description of the Prior Art

The musical tone which is generally generated by an electronic musical instrument has an envelope waveform as shown in FIG. 5. In FIG. 5 the arrow mark "a" indicates a key ON timing, the arrow mark "b" indicates a key OFF timing, 101 is an attack section, 102 is a fist decay section, 103 is a sustain section, 104 is a release section. Soon after a key is turned on, the attack section 101 and fast decay section 102 are formed. While key ON is kept, the sustain section 103 of constant level is formed. If a key is turned off, the release section 104 of decay waveform is formed, and the tone is cleared.

The general keyboard type electronic musical instrument has 8 to 16 sound sources. The number of musical tones which can be generated at the same time is equal to the number of a sound sources. When a key of keyboard is depressed, the control circuit assigns this sound successively to the sound sources waiting for tone generation so that a tone is generated. In the case when two or more keys are depressed simultaneously or when the sustain pedal is used, the number of tones to be generated may exceed the number of sound sources. In such a case the first generated musical tone is forcibly cleared and a new musical tone is generated. But if a musical tone being generated is cleared, a click-like noise unfavorable for musical tone occurs. Therefore, in the case when a musical tone being generated must be once cleared and then next new musical tone must be generated, the musical tone to be cleared is not cut off but rapidly decayed (force-damped) as shown in FIG. 5 (105) to clear it, and then the new musical tone is generated after a proper time interval. The arrow mark "c" in FIG. 5 indicates a key ON timing of the new musical tone, the arrow mark "d" indicates the tone generating timing of the new musical tone.

When a musical tone which must be cleared is being generated at high level, force-damp takes much time. When tone is generated at low level, the required time is short. The conventional force-damp control (i.e. Japanese patent publication Sho 63-7394) features that the new musical tone is generated after a specific waiting time irrespective of at which stage of attack section-release section the musical tone being generated exists. Therefore when the force-damp is applied to a musical tone which is going to be cleared in the release section, excessive pause occurs due to excessively long waiting time. In the case when the force-damp is applied to the musical tone in the sustain state at high level, the waiting time is too short as compared to the force-damp time, so that the next musical tone is generated before the previous tone is cleared.

To eliminate these defects, the tone generation level of the musical tone to be cleared must be judged, and a waiting time proportional to this tone generation level must be set. However, to provide a function of detecting the tone generation level of analog musical tone signal and of taking it as digital data in the conventional electronic musical instrument (synthesizer, etc.) which uses a CPU for tone generation control, a detecting circuit and an A/D converter circuit are additionally required, so that the circuit becomes complicated and cost rises.

SUMMARY OF THE INVENTION

In brief, this invention contemplates an electronic musical instrument which has solved the above mentioned problems by judging a tone generation level based on the time counted from the beginning of slow decay (release section) and setting a waiting time for force-damp.

The electronic musical instrument of this invention is designed so that when a request to generate a new musical tone is given while a musical tone is being generated at one sound source, the new musical tone is generated after performing rapid decay (force-damp) of the musical tone whereupon tone generation level of the musical tone being generated is read from timer means at this time. Count value of a timer has a specific correlation with a decay of the musical tone. Therefore the tone generation level lowers as the timer count rises. A new tone waiting time is set based on the timer count. Thereby a proper waiting time can be set based on the toner generation level of the musical tone to be cleared, and the circuit for reading analog tone generation level is unnecessary. Therefore the circuit configuration can be simplified.

DESCRIPTION OF THE PREFERRED EMBODIMENT

Figure 1:
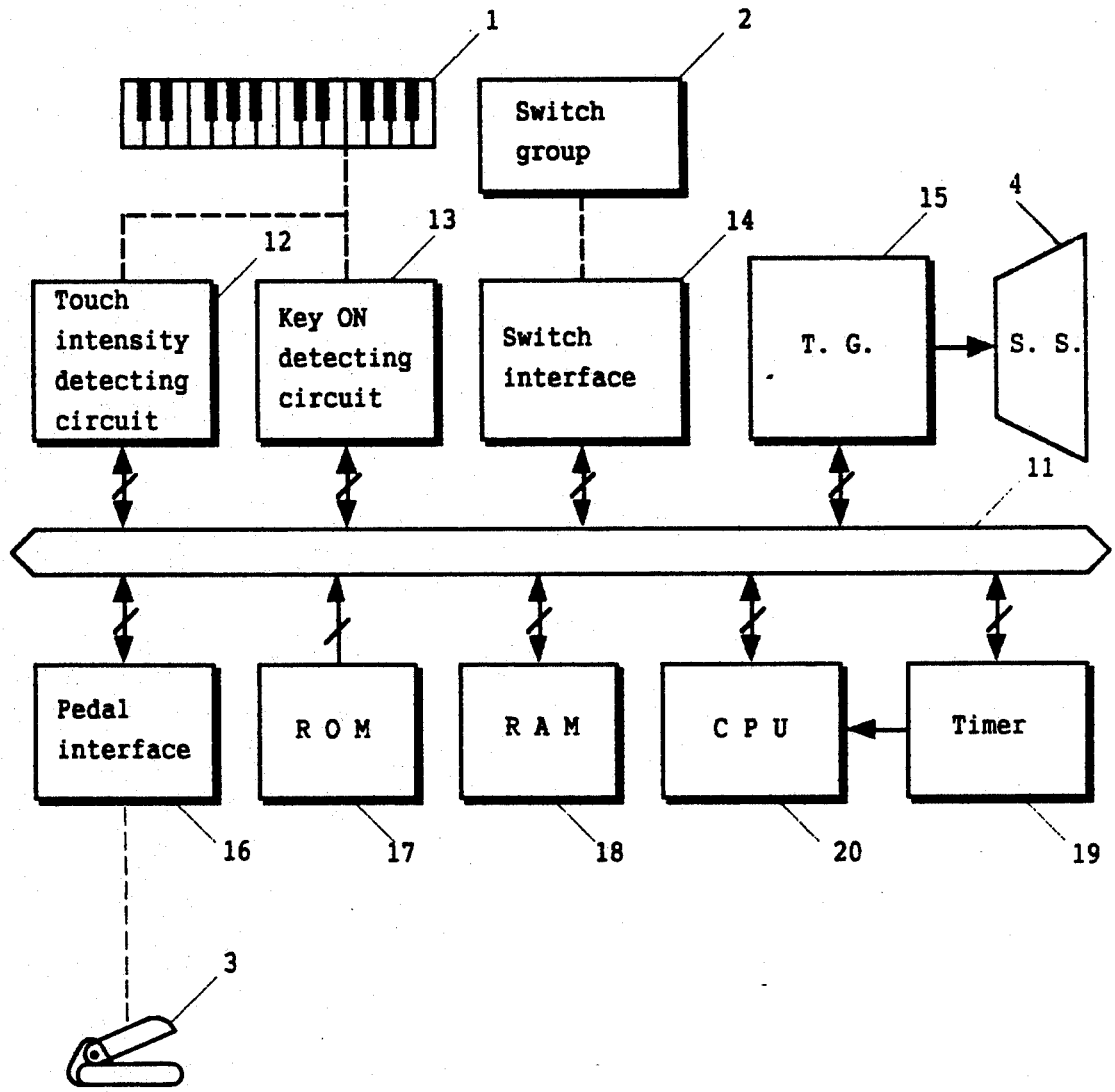
FIG. 1 is a block diagram of a control section of a keyboard type electronic musical instrument which is an example of an embodiment of this invention.
Figure 2A:
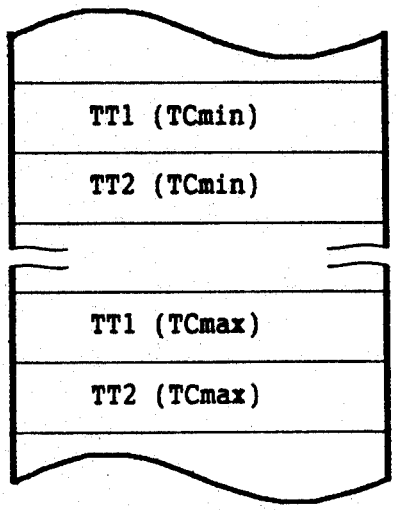
FIGS. 2 (A) to (C) show a partial configuration of the ROM of the control section.

FIG. 1 is a block diagram of an electronic musical instrument which is an example an embodiment of this invention. This instrument is a keyboard type electronic instrument. A keyboard 1 has a compass of about 4 to 5 octaves. A sound source 15 has 8 channels, each of which can independently generate a musical tone. At the external side of the musical instrument a group of switches 2, including a tone color selection switch, and a sound system 4, including a speaker, etc., are provided in addition to the keyboard 1. A sustain pedal 3 is connected to a main body of the electronic musical instrument through a connector. The operation of the musical instrument is controlled by CPU 20. Memories and each operation section are connected to CPU 20 through a bus 11. A touch intensity detecting circuit 12, a key ON detecting circuit 13, a switch interface 14, a sound source circuit 15, a pedal interface 16, a ROM 17, a RAM 18 and a timer 19 are connected to the bus 11. The touch intensity detecting circuit 12 and the key ON detecting circuit 13 detect touch intensity and ON-OFF of each key of keyboard 1. The switch interface 14 detects ON-OFF of each switch of the switch group 2. The sound source circuit 15 has an independent 8-channel sound source. It can generate 8 tones according to the waveform signals control signal and so on received from CPU 20. The sustain pedal 3 is connected to the pedal interface 16 and detects its ON-OFF. Data as shown in FIG. 2 is stored in the ROM 17. A storage area as shown in FIG. 3 is set in the RAM 18. The timer 19 gives an interruption to the CPU every about 2 ms. A sound system 4 is connected to the sound source 15 and outputs the musical tone generated by the sound source is outputted from a speaker.

After the power supply is turned on, the switch group 2 is operated to select tone color, etc. the player operates the keyboard 1 and the sustain pedal 3 to play the musical instrument.

FIGS. 2 (A) to (C) show a partial configuration of ROM17. ROM17 stores program, tone color data (TCmin–TCmax) and data for setting a waiting time. FIG. 2 (A) shows an address table. FIG. 2 (B) shows a decay rate table. FIG. 2 (C) shows a waiting time table. The decay rate table and the waiting time table are provided for each selectable tone color (TCmin–TCmax). The address table stores the start addresses of decay rate table and waiting time table for each tone color. In FIG. 2 (A) TT1 is a decay rate table start addressee whereas TT2 is a waiting time table start address.

The envelope waveform of musical tone is specified for each tone color. Therefore the level decay rate in the release section is constant if the tone colors are the same. Accordingly, if the level is subtracted according to level decay rate, taking as initial value the decay initial level which is determined based on the touch intensity, the tone generation level at each different timing can be predicted during the stage of decay. The force-damp time (waiting time) is proportional to tone generation level upon starting the force-damp. Accordingly, the waiting time can be determined by referencing to the tone generation level which is obtained by the above-mentioned prediction.

Figure 2B:
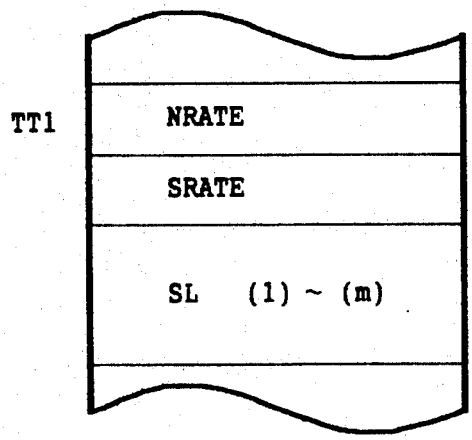
Figure 2B:
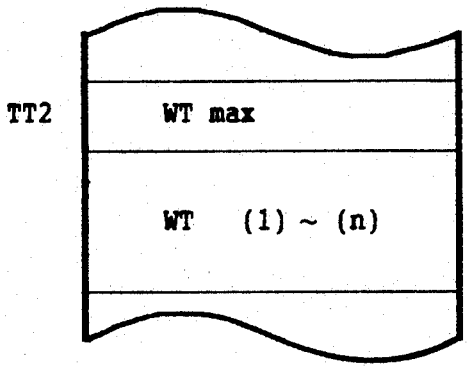
Figure 3:
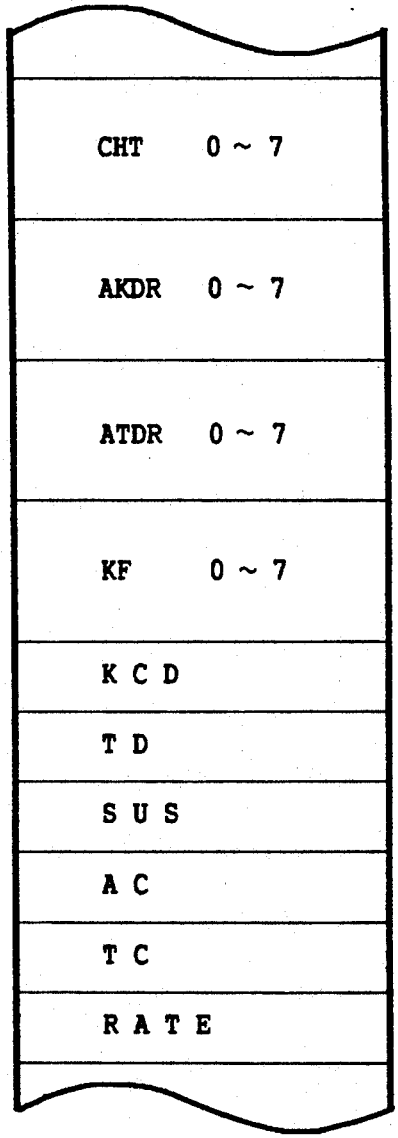
FIG. 3 shows a detail configuration of the RAM of the control section.

In FIG. 2(B), NRATE is ordinary decay rate whereas SRATE is decay rate at the time of sustain in the case where the sustain pedal is depressed. Both are stored as positive numbers. As a matter of course, SRATE is smaller than NRATE. SL is a decay initial value. m kinds of SL, 1 to m, are stored. One of them is selected according to the key touch intensity. SL is a negative number. As the touch intensity is increased, an SL having a larger absolute value is selected. One of the SLs is selected based on the touch intensity when decay is started (key off timing), and set in the counter CHT (FIG. 3), RATE (NRATE or SRATE) is added for each timer interrupt. When (CHT)>=0, it is judged that the musical tone has been cleared.

In an area shown in FIG. 2(C) several kinds of WT indicating the waiting time (1 to n or max) are stored. When a force-damp is applied in any section (attack section to sustain section) other than release section, it is presumed that the tone generation level is sufficiently high. Therefore the maximum waiting time WTmax is selected. In the release section a proper WT(i) corresponding to the value of CHT (negative number) is selected. WT is a positive number. In the case of force-damp it is set in the counter CHT in place of SL. After setting in the counter CHT the count is decremented for each timer interrupt. When 0 is reached, the waiting time ends.

FIG. 3 shows a partial configuration of RAM18. The timer counter CHT, a key code register AKDR, a touch intensity register ATDR and a key flag KF are set in this RAM for each channel (0 to 7) of sound source circuit 15. The timer counter CHT (i) is used for predicting the release state in the pertinent channel as mentioned above and to count the waiting time of the force-damp. The key code register AKDR (i) and the touch intensity register ATDR (i) store the key code and the touch intensity assigned to this channel, respectively. The key flag KF (i) is used to indicate whether or not the key assigned to the channel is turned on (whether or not it is in the release section).

The RAM18 contains the key code buffer KCD which is designated to buffer the key code of a pertinent key in case of key ON event, the touch intensity buffer TD, the sustain flag SUS indicating that the sustain pedal has been depressed, the specified channel register AC designated to store a specified channel, the tone color register TC designated to store a select tone color number, and the decay rate register RATE designated to store a decay rate specified by ON/OFF of sustain pedal and tone color.

Figure 4:
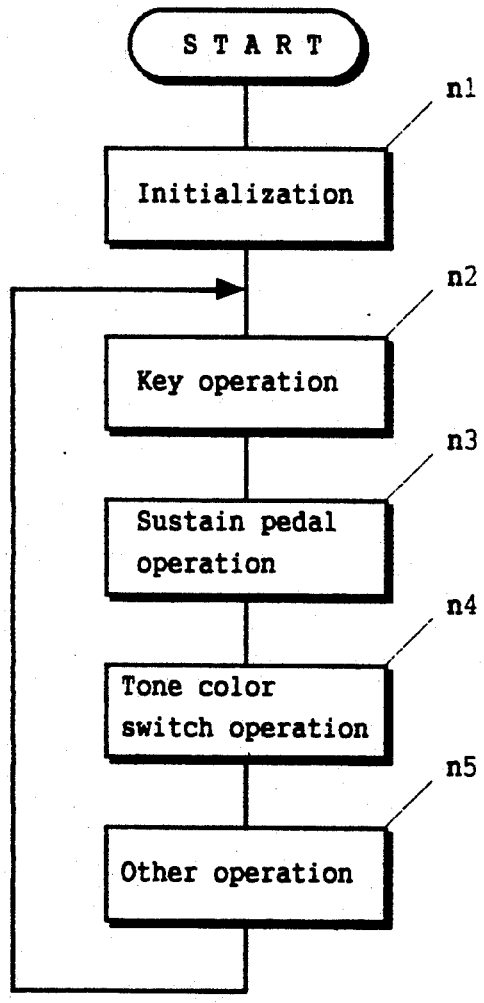
FIGS. 4 (A) to (F) are flow charts showing the operation of the control section.
Figure 4:
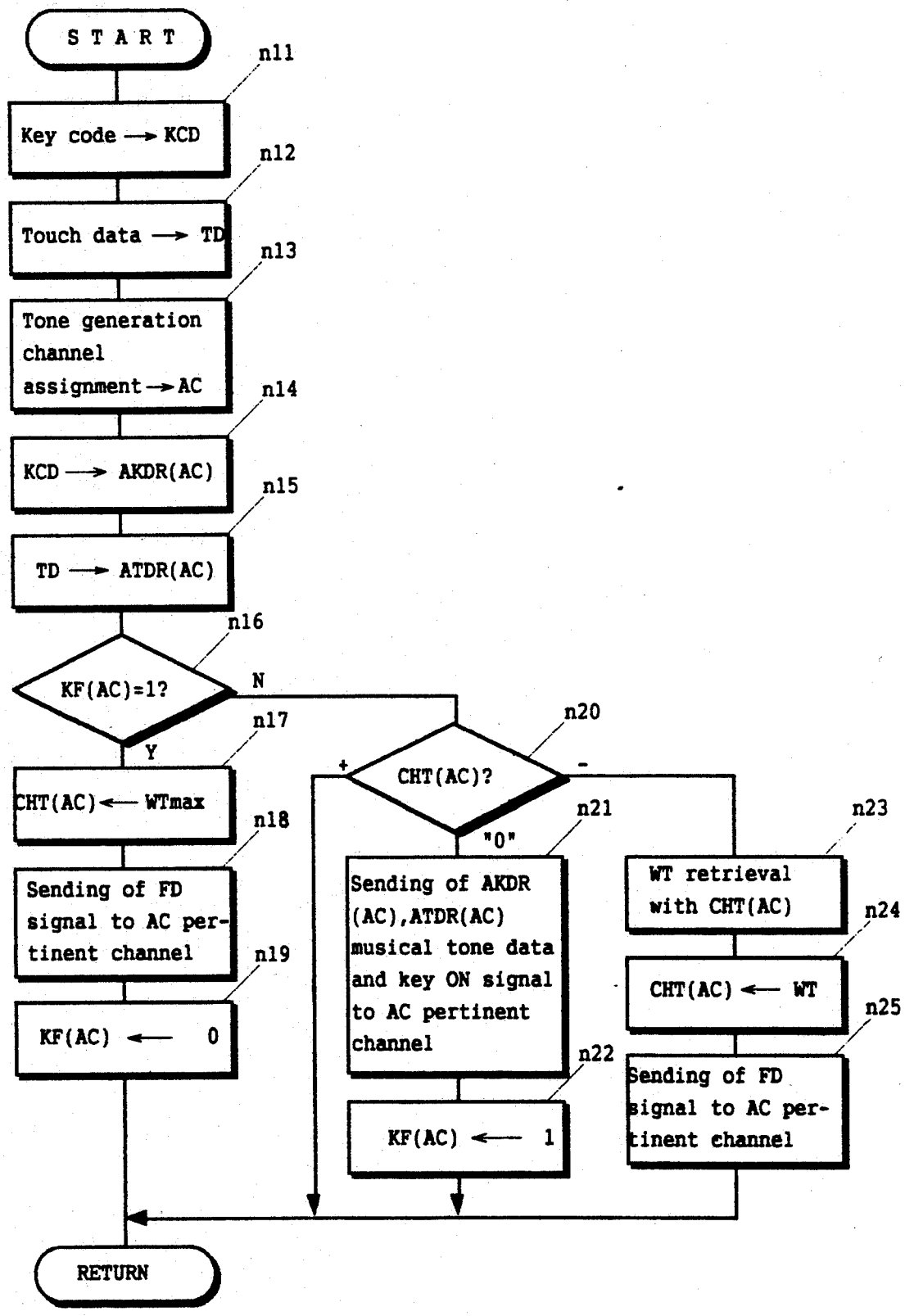
Figure 4:
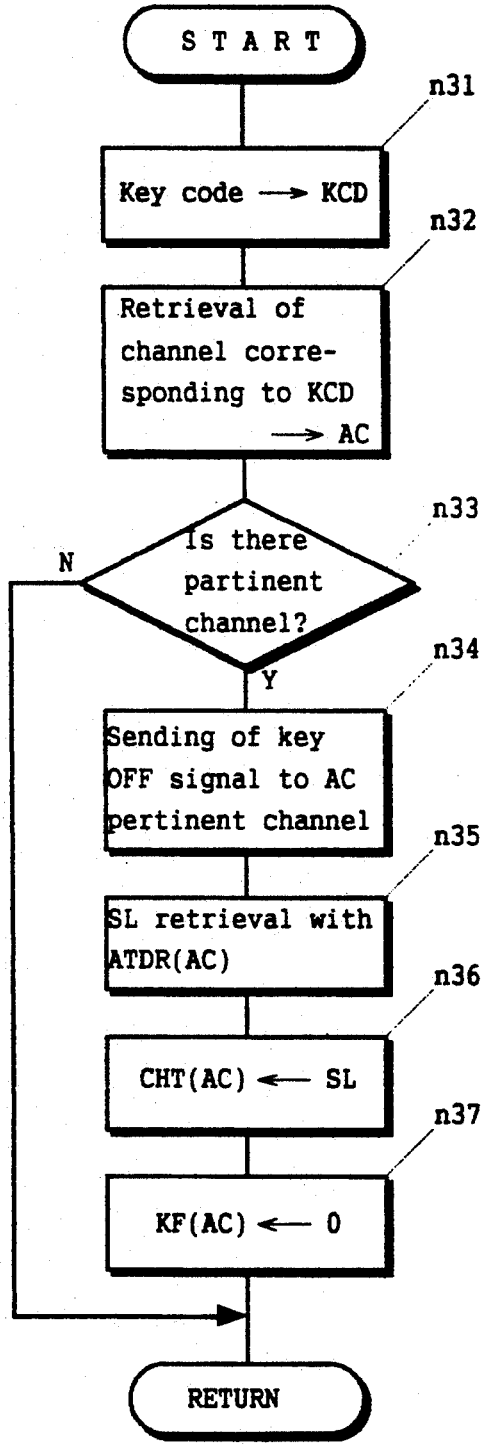
Figure 4:
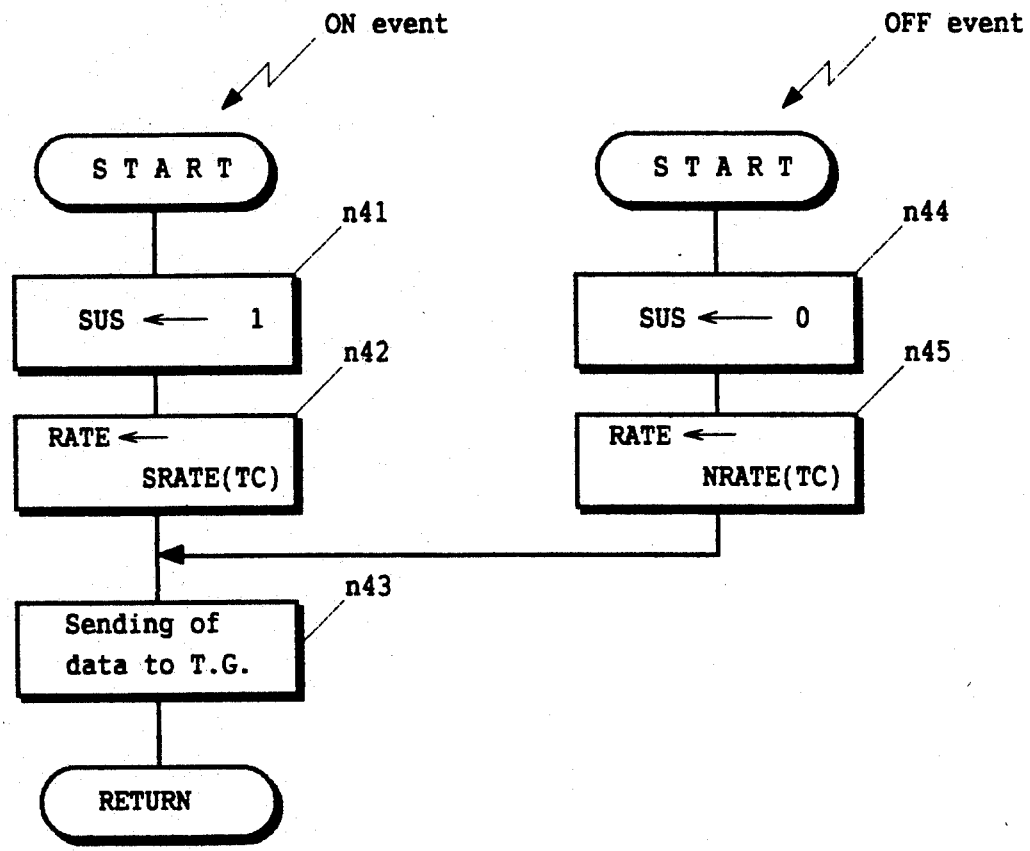
Figure 4:
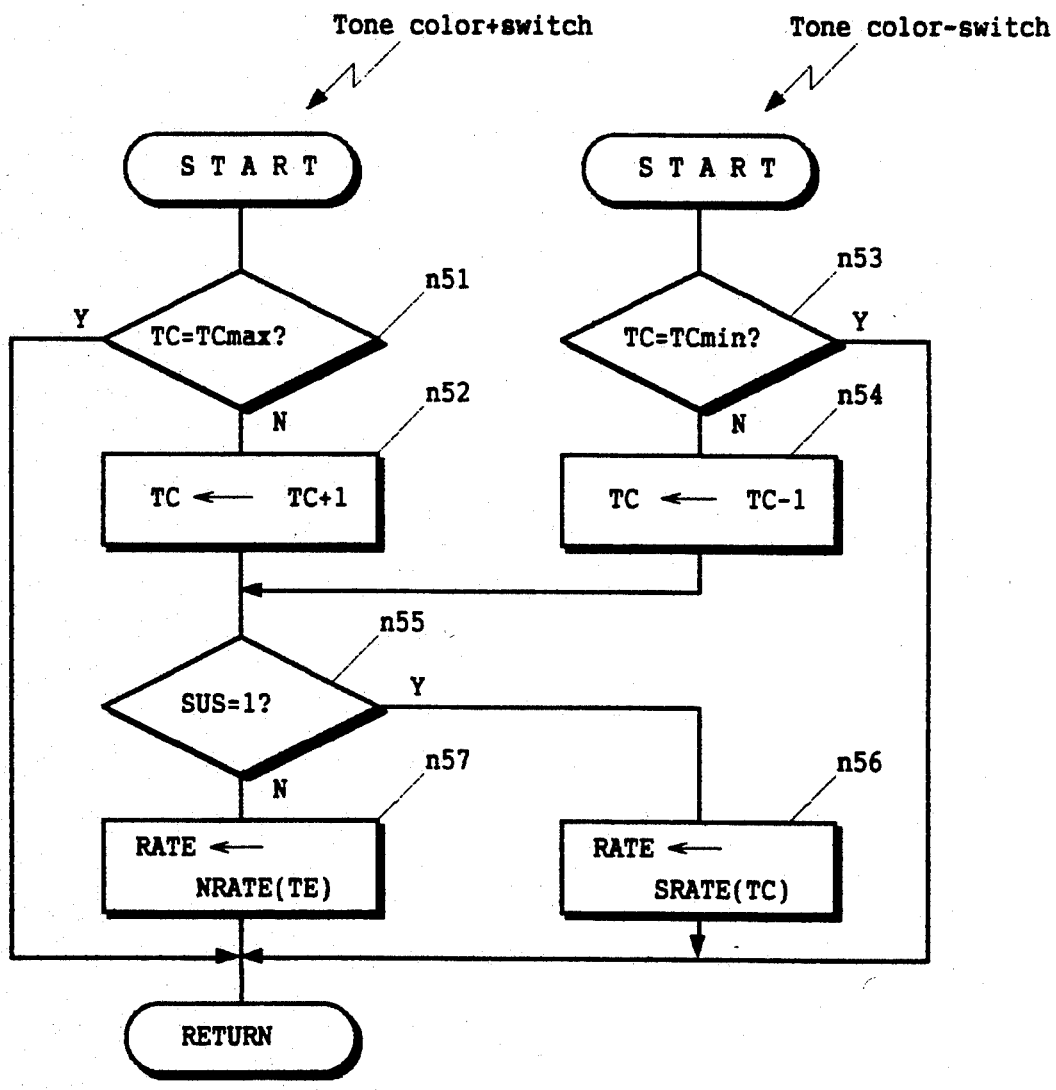
Figure 4:
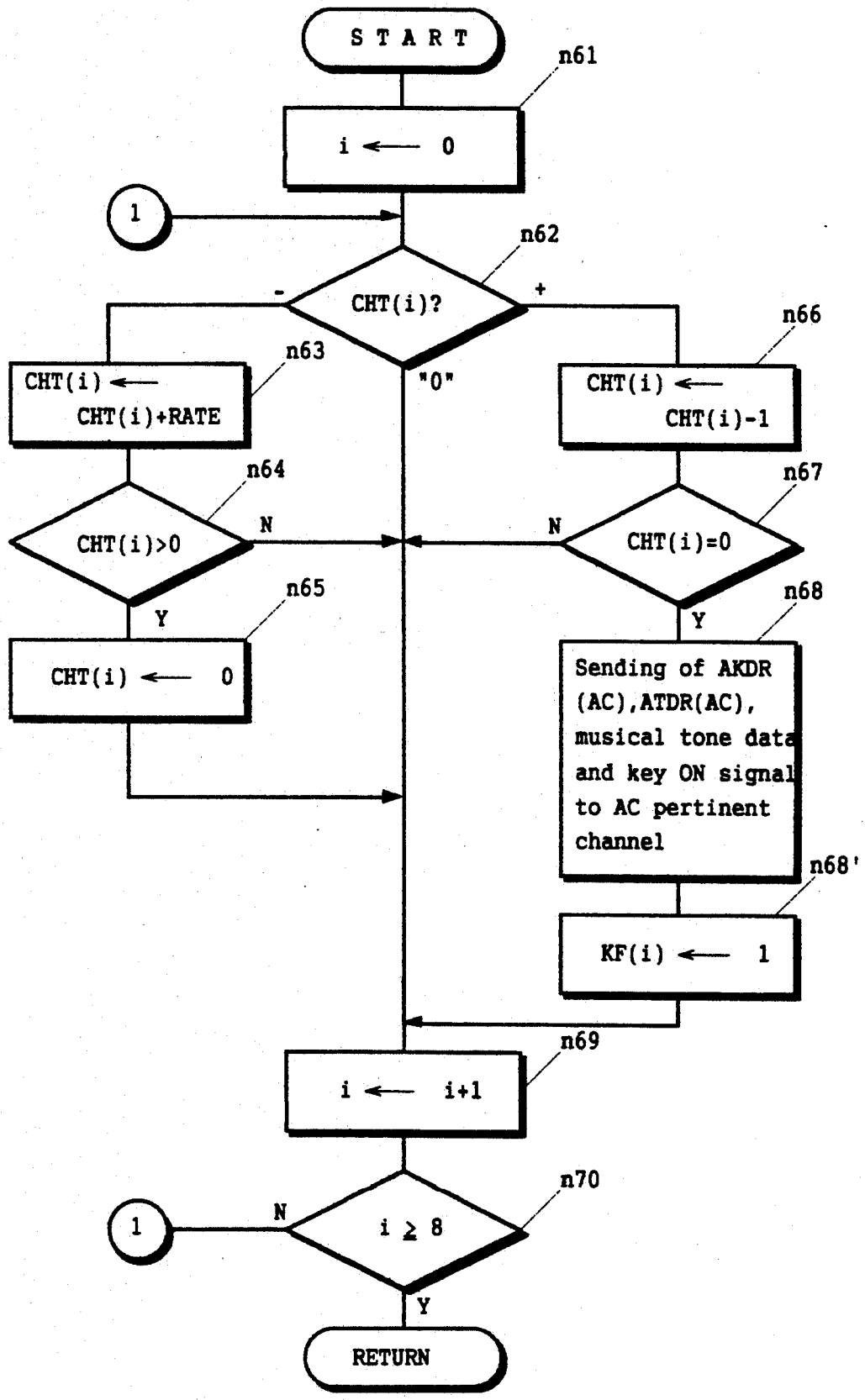

FIG. 4 shows flow charts indicating the operation of the electronic musical instrument. FIG. 4(A) shows a main flow chart. FIGS. 4(B) to (E) show subroutines at each stage. FIG. 4(F) shows a timer interrupt operation. When a power switch is turned on in FIG. 4(A), at first an initial setting is performed (n1). Then the operation state of each control section is scanned. At the step n2 a judgment of key ON/OFF is performed, and pertinent processing is performed. At the step n3 a judgment of ON/OFF of sustain pedal is performed, and a pertinent processing is executed. At the step n4 a judgment of tone color switch operation is performed, and a pertinent processing is executed. At the step n5 a judgment of operation of other key switches is performed, and a pertinent processing is executed.

FIG. 4(B) shows a key ON event subroutine. If any key is turned on, its key code and the touch intensity are read into the key code buffer KCD and the touch intensity buffer TD, respectively (n11, n12), and a sound source channel to generate this tone is assigned (n13). Usually, an empty channel is assigned. If all the channels are being used for tone generation, the channel which has generated a tone first or the channel of the lowest generation level is assigned. The number of the assigned channel (0 to 7) is stored in the specified channel register AC (n14). After the key code KCD and the touch intensity TD are stored in the key code register AKDR (AC) and the touch intensity register ATDR (AC) of the specified channel (n15), the key flag KF(AC) of this channel is referenced (n16). If the flag KF (AC) has been set, this means that the previously assigned tone is being generated (attack section-sustain section). Therefore the force-damp must be applied. Consequently, WTmax is set in the timer counter CHT(AC) as a waiting time (n17), and after a force-damp signal is sent to the sound source channel (n18), the flag KF(AC) is reset (n19), and the process returns.

If the flag KF(AC) has been reset, the timer counter CHT (AC) is judged (n20). If it is "0", this means that the channel is empty. Accordingly, AKDR(AC), ATDR(AC), musical tone data, key ON signal, etc. are sent to this sound source channel (n22), the flag KF (AC) is set to ON (n22), and the process returns. Thereby a musical tone is generated at once. If (CHT(AC))<0, this means that a musical tone is being generated in the release section. In this case a tone generation level is predicted from (CHT(AC)). Then a waiting time WT(i) corresponding to it is selected and set in the counter CHT(AC) (n23, n24). After that a force-damp signal is sent to this sound source channel (n25), the process returns. If (CHT(AC))>0, this means that force-damp is being performed. Consequently, a waiting time lasts until (CHT(AC))=0 is obtained. Therefore, the process returns in this state (n20).

FIG. 4(C) shows a key OFF event subroutine. If a key is set to OFF, this subroutine is executed. At the step n31 the key code of the key which has been set to OFF is taken into KCD. The AKDR(i) which corresponds to this KCD is retrieved, and a corresponding channel number is stored in AC (n32). If corresponding AKDR is not found, it is judged that a musical tone corresponding to this key has been already force-damped, and the process returns (n33). If any corresponding AKDR is found, a key OFF signal is sent to the sound source channel of channel number AC (n34), and then the decay initial value SL is selected according to the content of touch intensity register ATDR (AC) (n35). Taking into consideration that the decay time increases as the touch intensity increases, an initial value (a negative number of larger absolute value) according to the key touch intensity is selected. This SL is set in CHT (AC) (n36), the key flag KF (AC) is reset, and then the process returns (n37).

FIG. 4(D) shows a sustain pedal subroutine. When the sustain pedal is turned on, the operation of steps n41 to n43 is executed. At the step n41 the sustain flag SUS is set, the sustain decay rate SRATE is set in RATE (n42), and then these data are sent to the sound source 15 (n43). If the sustain pedal is turned off, the operation of steps n44, n45, and n43 is executed. At the step n44 the sustain flag SUS is reset, and the ordinary decay rate NRATE is set in RATE (n45). These data are sent to the sound source 15 (n43), and then the process returns.

FIG. 4(E) shows a tone color selection subroutine. When the tone color selection switch is pressed, the subroutine is executed. The tone color selection switch consists of "tone color+switch" and "tone color—switch". The tone color number TC can be increased or decreased by pressing these switches. Player specifies a tone color by specifying its number. CPU 20 identifies the tone color according to the tone color number. When the "tone color+switch" is pressed, a judgment as to whether or not TC has been set already to TCmax is performed (n51). If it has been set already to TCmax, the process returns. If TC has not been set to TCmax, "1" is added to TC (n52). When the "tone color-switch" is pressed, a judgment as to whether or not TC has been set already to TCmin is performed (n53). If TC has been set to TCmin, the process returns. If TC has not been set to TCmin, "1" is subtracted from TC (n54). Then SUS is judged (n55). If it has been set, SRATE (TC) of newly set tone color TC is set in RATE (n56). If it has been reset, NRATE (TC) is set (n57).

FIG. 4 (F) shows a flow chart indicating the timer interruption. This operation is executed by applying an interruption to CPU20 at every specific count (about 2 ms) of timer 19. At the step n61 the channel pointer "i" is set to 0. At the step n62 the value of CHT(i) is judged. If this value is "0", this means that this sound source channel (the sound source channel indicated by the pointer "i") does not have musical tone and is at rest, so that the process proceeds to the step n69. If CHT (i) has a negative number, this means that the current process is in release (decay) state. Therefore RATE is added to CHT(i) (n63). If overflow of CHT(i) occurs as a result of this addition, "0" is set in CHT(i), and the process proceeds to the step n69. If CHT(i)=0, tone is cleared. If CHT(i) has a positive number, this means that the force damp is being performed. Therefore, "1" is subtracted from CHT(i) (n66), and a judgment as to whether or not CHT(i) is equal to "0" is executed (n67). If it is equal to "0", this means that the force-damp waiting time has expired. Accordingly, so as to generate the next musical tone, AKDR(i), ATDR(i), musical tone data and key ON signal for the next musical tone are sent the channel corresponding to "i" (n68), KF(i) is set (n68'), and then the process proceeds to the step n69. At the step n69 "1" is added to the pointer "i". The operations from n62 to n69 are repeated until "i" becomes equal to 8 as a result of above-mentioned addition. When "i" becomes equal to 8, this means that the above-mentioned operation has been finished for all channels (n70), and the process returns.

In the embodiment explained above, WTmax is chosen as the waiting time of force-damp in any section other than release section. For the sustain section it is allowed to set the waiting time WT according to touch intensity.

Figure 5:
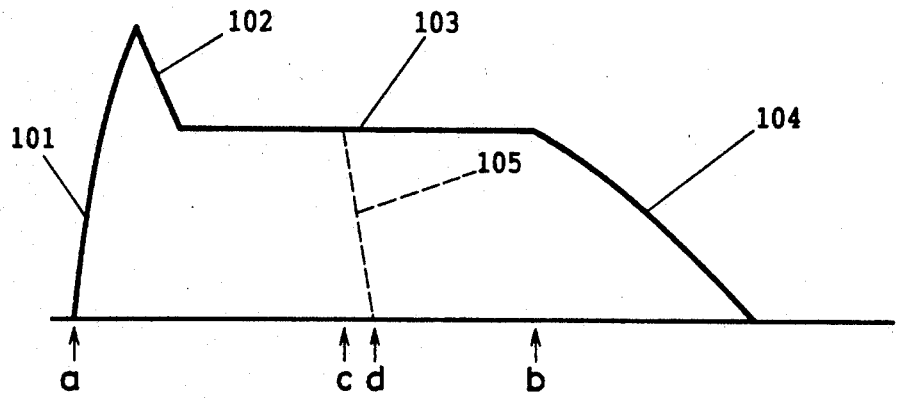
FIG. 5 shows an envelope waveform of musical tone of the holding tone system.
Figure 6:
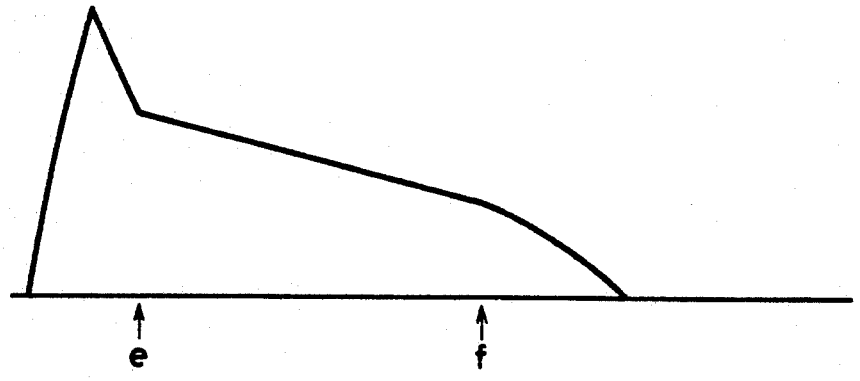
FIG. 6 shows an envelope of musical tone of the decay tone system.

In the example of embodiment explained above, an explanation is given as to tone color (refer to FIG. 5) of holding tone system where the tone generation level does not change during key ON period after attack. In the case of the tone color of the decay tone system where the level decays gradually after attack as shown in FIG. 6, it is allowed that the timer counter CHT is started after attack and first decay (arrow mark e). In this case RATE is changed before and after key OFF (arrow mark f).

What is claimed is:

1. An electronic musical instrument comprising:

a tone generator including a plurality of tone production channels for generating a plurality of musical tones;

timer means for measuring a lapse of time beginning from a key off signal of a first tone assigned to one of the plurality of tone production channels, and ending when a key on signal of a second tone is assigned to said one tone production channel;

decay means for rapidly decaying an amplitude of said first tone when said second tone is assigned to said one tone production channel, said decay means decaying said amplitude of said first tone over a period of time based on said measured lapse of time from said timer means, said period representing a time to cancel said amplitude of said first tone; and delay means for determining a delay time based on said measured lapse of time from said timer means, said delay time representing a time from when said second tone is assigned to said one tone production channel up to a generation of said second tone.

2. An electronic musical instrument according to claim 1, further including a keyboard having a plurality of keys, wherein said predetermined portion represents a point in the first tone where one of the plurality of keys is released.

3. An electronic musical instrument according to claim 1, wherein said delay means determines said delay time in accordance with a tone color of said first tone.

4. An electronic musical instrument according to claim 1, wherein said delay means determines said delay time in accordance with touch data representing a strength of performance of said electronic musical instrument by a performer.

5. An electronic musical instrument according to claim 1, further comprising sustain means having a sustain member for sustaining a tone to be produced when said sustain member is operated, wherein said delay means determines said delay time in accordance with an operating state of said sustain member.

6. An electronic musical instrument comprising:

tone generator means including a plurality of tone production channels for generating a plurality of tones;

input means for designating a tone to be produced, including a first designated tone and a second designated tone;

tone production channel assigning means for assigning at least one of said plurality of tone production channels to produce said first or second designated tone;

input state detecting means for detecting, for each of said plurality of tone production channels, a corresponding operation of said input means, and setting an input state flag based on said detected corresponding operation;

timer means for monitoring for each of said plurality of tone production channels, an amount of time beginning from said detected corresponding operation of said input means, and ending when said second designated tone is assigned to said one tone production channel;

force-damp means for force-damping said first designated tone currently being generated by said one tone production channel in response to said assignment of said second designated tone to said one tone production channel to produce said second designated tone, said force damping means damping said first designated tone over a period of time based on said input state flag and said amount of time monitored by said timer means, said period representing a time to damp said first designated tone; and delay means for delaying production of said second designated tone by said one tone production channel for a predetermined period of time.

7. An electronic musical instrument according to claim 6, wherein said delay means further comprises delay determining means for determining a length of said predetermined period of time based on said input state flag and said amount of time monitored by said timer means for said one tone production channel.

8. An electronic musical instrument according to claim 7, wherein said input means comprises a keyboard including a plurality of keys, each of said plurality of keys being switchable between a key-on state and a key-off state.

9. An electronic musical instrument according to claim 8, wherein the corresponding operation comprises a switching of one of the plurality of keys from a key-on state to a key-off state.

10. An electronic musical instrument comprising:

tone generator means for generating a musical tone;

input means for designating a new tone to be generated;

input state detecting means for detecting an operation of said input means, and setting an input state flag based on said detected operation;

timer means for monitoring an amount of time beginning from said detected operation of said input means on an old tone, and ending when said new tone is designated by said input means;

force-damp means for force-damping said old tone currently being generated by said tone generator means in response to said designation of said new tone to be generated, said force damping means damping said old tone over a period of time based on said input state flag and said amount of time monitored by said timer means, said period representing a time to damp said old tone, and;

delay means for delaying generation of said new tone by a predetermined period of time; and delay determining means for determining a length of said predetermined period of time based on said input state flag and said amount of time monitored by said timer means.

11. An electronic musical instrument according to claim 10, wherein the input means comprises a keyboard including a plurality of keys, each of the plurality of keys being switchable between a key-on state and a key-off state.

12. An electronic musical instrument according to claim 11, wherein the detected operation comprises a switching of one of the plurality of keys from a key-on state to a key-off state.

13. An electronic musical instrument comprising:

a tone generator including a plurality of tone production channels for generating a plurality of musical tones;

timer means for measuring a lapse of time beginning from a point on an envelope waveform of a first tone assigned to one of the plurality of tone production channels, ending when a second tone is assigned to said one tone production channel, and setting a tone generation state flag based on generation of said first tone;

decay means for rapidly decaying an amplitude of said first tone when said second tone is assigned to said one tone production channel, said decay means decaying said amplitude of said first tone over a period of time based on said tone generation state flag and said measured lapse of time from said timer means, said period representing a time to cancel said amplitude of said first tone; and delay means for determining a delay time based on said tone generation state flag and said measured lapse of time from said timer means, said delay time representing a time from said second tone generation assignment up to a generation of said second tone.

14. An electronic musical instrument according to claim 13, further including a keyboard having a plurality of keys wherein said point on said envelope waveform represents a point in said first tone where one of said plurality of keys is released.

15. An electronic musical instrument according to claim 13, wherein said delay means determines said delay time in accordance with a tone color of said first tone.

16. An electronic musical instrument according to claim 13, wherein said delay means determines said delay time in accordance with touch data representing a strength of performance of said electronic musical instrument by a performer.

17. An electronic musical instrument according to claim 13, further comprising sustain means having a sustain member for sustaining a tone to be produced when said sustain member is operated, wherein said delay means determines said delay time in accordance with an operating state of said sustain member.

* * * * *